US005178524A

United States Patent [19]

Nicol

[11] Patent Number: 5,178,524

[45] Date of Patent: Jan. 12, 1993

[54] FUEL INJECTION PUMP

[75] Inventor: Stuart W. Nicol, London, England

[73] Assignee: Lucas Industries, Solihull, England

[21] Appl. No.: 710,883

[22] Filed: Jun. 6, 1991

[30] Foreign Application Priority Data

Jun. 8, 1990 [GB] United Kingdom ..... 9012841

[51] Int. Cl.[5] ..... F04B 19/02; F01B 1/00

[52] U.S. Cl. ..... 417/462; 92/72; 92/129

[58] Field of Search ..... 417/462, 463; 91/491; 92/72, 129

[56] References Cited

U.S. PATENT DOCUMENTS 3,861,833 1/1975 Salzgeber ..... 417/462

3,883,270 5/1975 Baxter ..... 417/462

FOREIGN PATENT DOCUMENTS 1318196 9/1969 United Kingdom ..... 417/462

*Primary Examiner*—Leonard E. Smith

*Assistant Examiner*—Roland McAndrews

*Attorney, Agent, or Firm*—Jenner & Block

[57] ABSTRACT

A rotary distributor type fuel pumping apparatus for supplying fuel to an internal combustion engine has a radially disposed plunger located in a radial bore in the distributor member. The plunger is moved inwardly by a cam follower including a shoe engaging the plunger and a roller which engages cam lobes formed on a cam ring surrounding the distributor member. The cam follower is located in a slot in a part rotating with the distributor member and is so arranged that the roller is offset from the plunger in the direction of rotation of the distributor member.

5 Claims, 3 Drawing Sheets

FUEL INJECTION PUMP

This invention relates to a rotary distributor type fuel injection pump for supplying fuel to an internal combustion engine, the pump comprising a plunger slidable within a radial bore formed in a rotary distributor member, means for feeding fuel to the bore to effect outward movement of the plunger, an annular cam ring surrounding the distributor member and having inwardly projecting cam lobes for imparting inward movement to the plunger as the distributor member rotates so that fuel is expelled from the bore, the fuel being supplied to outlet ports in turn, a cam follower including a roller mounted in a shoe, located between the outer end of the plunger and the cam ring, the cam follower being slidable within a slot formed in the distributor member or in a part rotatable therewith.

The conventional practice is to arrange for the cam follower to be guided for movement by the slot, in a radial direction with the axis of movement of the plunger intersecting the axis of the roller. The surface of the shoe which engages the outer end of the plunger is machined so that contact between the shoe and the plunger occurs on or near the axis of the plunger so as to minimize side thrust on the plunger which might otherwise cause seizure of the plunger within the bore. With the above arrangement when the roller engages the leading flank of a cam lobe, the cam follower will tend to tilt in the slot so that the inner and outer side edges of the shoe on opposite sides of the shoe, will be urged into engagement with the walls of the slot and if the shoe is of the type which projects from the slot in order to extend the range of movement of the plunger, the outer edge of the slot will be urged into engagement with the side wall of the shoe. The engagement between the shoe and the slot leads to high contact stress and possible failure of the lubricant film, the lubricant normally being the fuel which is delivered by the pump.

The object of the invention is to provide a pump of the kind specified in a simple and convenient form.

According to the invention in a pump of the kind specified, the roller is off set from the plunger in the direction of rotation of the distributor member and the surface of the shoe which engages with the plunger is radiused about an axis which coincides with the axis of the plunger.

An example of a fuel injection pump in accordance with the invention will now be described with reference to the accompanying drawings in which.

Figure 1:
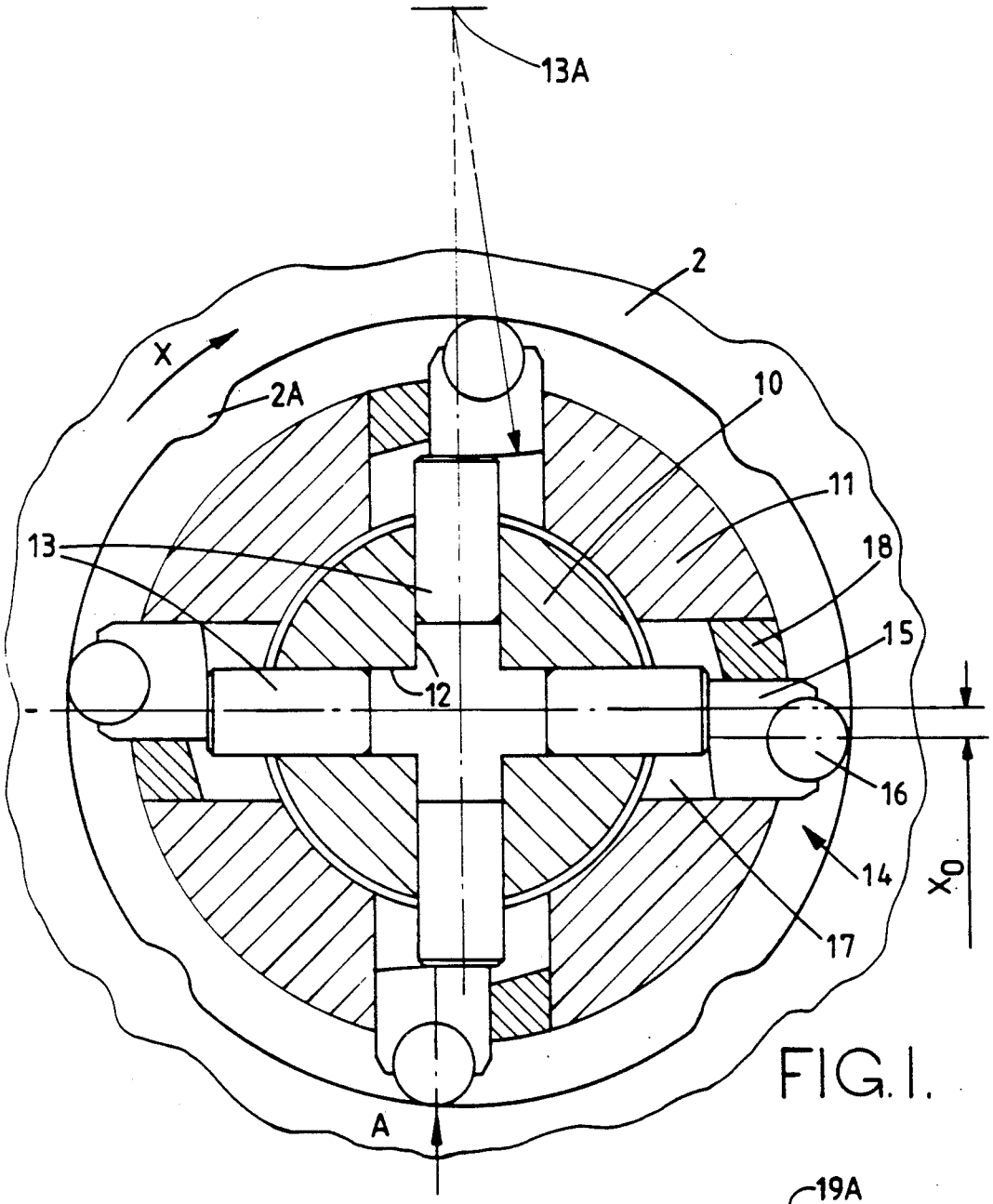
FIG. 1 is a sectional end elevation of part of the pump
Figure 2:
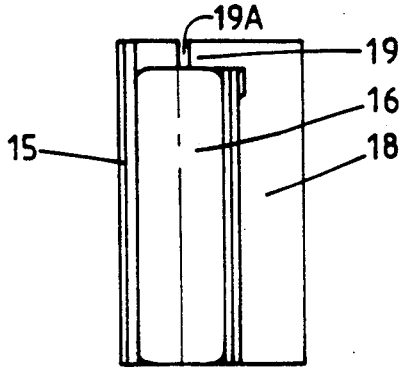
FIG. 2 is a view in the direction of the arrow A. of FIG. 1 of part of the pump seen in FIG. 1
Figure 3:
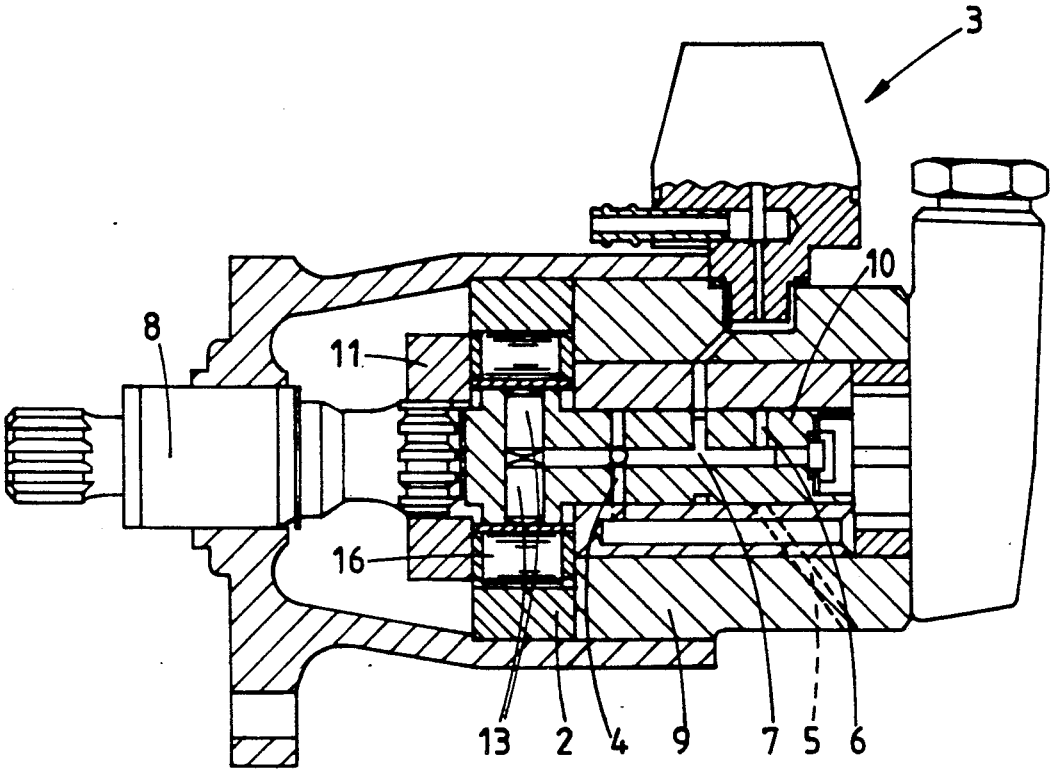
FIG. 3 is a sectional side elevation of the pump.

Referring to the drawings the pump is of the rotary distributor type which is well known in the art and which comprises a housing 9 in which is mounted a rotary cylindrical distributor member 10 which is driven by means of a drive shaft 8 in timed relationship with the associated engine. Surrounding the distributor member is an annular drive member 11 which may form part of the drive shaft but is at least coupled thereto.

Formed in the distributor member is a pair of transverse bores 12 which intersect, and mounted in each bore is a pair of pumping plungers 13. The portions of the bores at the inner ends of the plungers constitute a pumping chamber and this by way of a passage 7, communicates with a delivery passage 6 in the distributor member, which is positioned to register in turn with outlet ports 5 formed in the housing of the pump. The communication between the delivery passage and an outlet port occurs during the time when the plungers are moved inwardly. Fuel can be supplied to the pumping chamber to effect outward movement of the plungers through filling passages 4, and spill fuel control means 3 is provided to determine the amount of fuel which is supplied to the associated engine.

Figure 4:
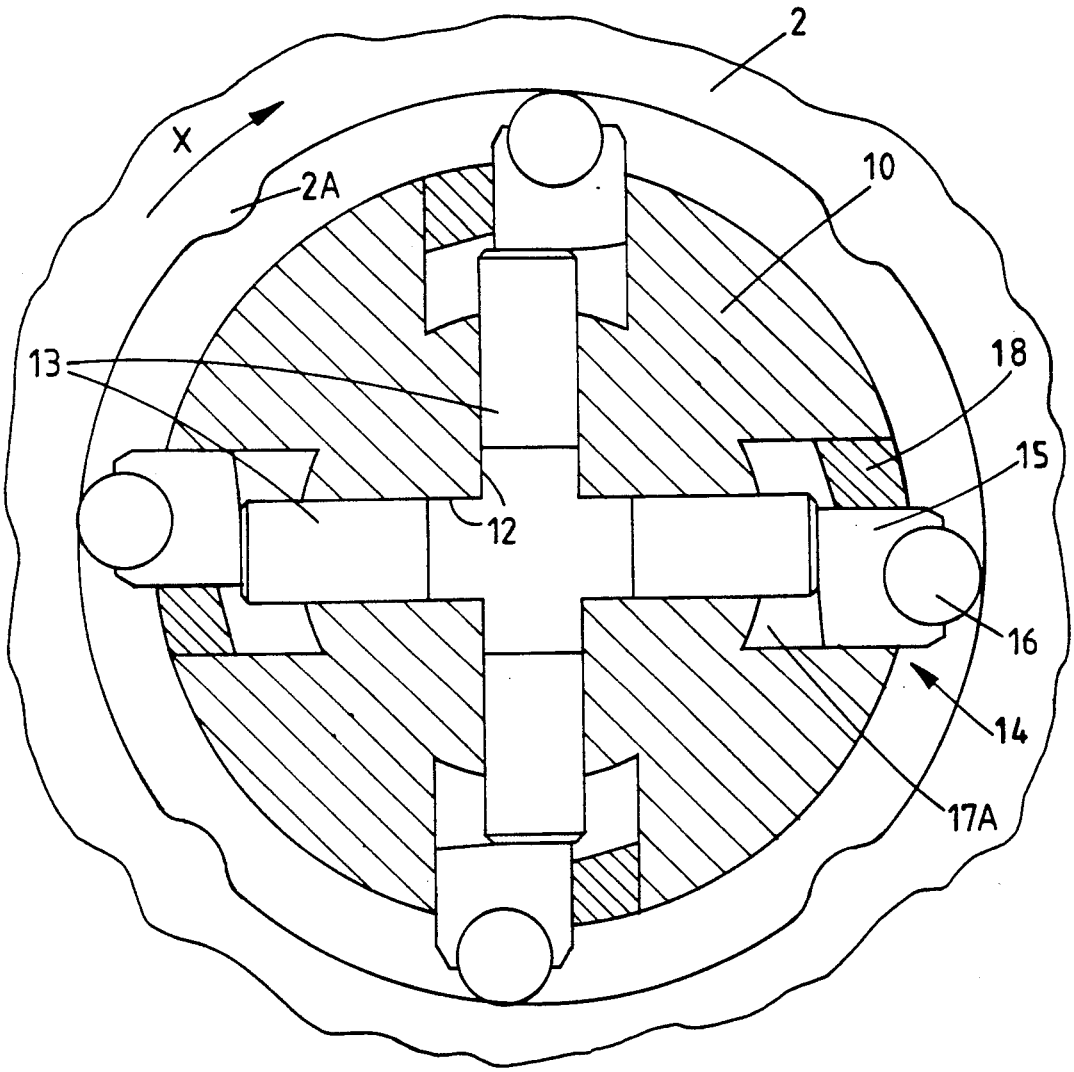
FIG. 4 is a sectional end elevation view of another embodiment of a pump according to the present invention.

At their outer ends, the plungers are engaged by cam followers 14 respectively each cam follower comprising a shoe 15 and a roller 16 which is located within a shaped recess formed in the shoe. The shoes are driven by the drive member 11, each shoe being located and slidable within a slot 17A respectively, formed in the drive member, as shown in FIG. 4. Alternatively, the shoes may be located and slidable within a slot 17 formed in a part which rotates with the distributor member, as shown in FIG. 1.

The rollers during rotation of the distributor member, engage cam lobes formed on the internal peripheral surface of a cam ring 2 which surrounds part of the drive member 11 and as the rollers engage the leading flanks of the cam lobes 2A, the cam followers and the plungers will be moved inwardly to displace fuel from the pumping chamber through an outlet port 5. The profile of the leading flanks of the cam lobes is generally such that the initial inward movement of the plungers is at a low rate, the rate increasing as the rollers travel up the leading flanks of the cam lobes. This applies to a pump of the type in which the quantity of fuel supplied to the associated engine is controlled by spilling fuel at some point during the inward movement of the plungers.

The conventional practice is for the longitudinal axes of the rollers 16 to coincide with the axes of movement of the plungers 13 and as compared with the pump shown in the drawing, the slots 17 and 17A are of a width corresponding to the width of the shoes. Moreover, the surface of the shoe which engages the plunger is radiused about an axis which is parallel to the axis of the roller so as to ensure so far as is possible, that the force moving the plungers inwardly is applied on or near the axis of the plungers. With the conventional arrangement when a roller 16 engages the leading flank of a cam lobe, the associated shoe tends to tilt so that the outer and trailing edge of the shoe is urged into engagement with the wall of the slot as also is the inner and leading edge of the shoe. In situations where the shoe extends from the slot, the trailing and outer edge of the slot engages the adjacent side wall of the shoe and substantial contact stress occurs which can cause breakdown of the lubricant film.

In order to minimize the aforesaid problem, the rollers are off set in the direction of rotation of the distributor member relative to the plungers. In FIG. 1 the direction of rotation of the distributor member and drive member is indicated by the arrow X. and, as will be seen, the rollers 16 are off set in the direction of rotation by the distance XO. Whilst it is possible to machine the slots 17 and 17A to support the cam followers so that the rollers assume their off set positions, it is more convenient and, as is illustrated, to manufacture the slots 17 and 17A to increased width and to maintain their radial form and to provide a packing piece 18 which is disposed between the trailing surface of the shoe and the adjacent surface of the slot. Moreover, the surface of the cam follower which engages the plunger is radiused about an axis 13A which is normal to and coincides with the axis of the plunger so that the line of contact between the shoe and the plunger more or less coincides with the axis of the plunger.

In use, with the rollers off set in the direction of rotation of the distributor member, when the roller engages the leading flank of the cam lobe there is a tendency for the cam follower to slide laterally so that its trailing side wall engages fully with the adjacent surface of the packing piece and this engagement remains throughout the inward movement of the plunger. The forces acting between the packing pieces and the shoes are therefore distributed over the contacting surfaces and as a result there is a lower contact pressure and there is less likelihood of the lubrication film being broken.

Since the cam followers are no longer symmetrical, it is necessary to ensure that they are assembled correctly and therefore each packing piece 18 is provided with a shoulder 19 at one end. This provides for axial location of the cam follower. The shoulder 19 engages within a recess 19A formed in the adjacent end of the shoe.

The construction can also be applied to pumps of the type in which the quantity of fuel supplied to the bores 12 is controlled so that the plungers and followers do not move out their maximum extent.

I claim:

1. A rotary distributor type fuel injection pump for supplying fuel to an internal combustion engine, comprising a plunger slidable within a radial bore formed in a rotary distributor member, means for feeding fuel to the bore to effect outward movement of the plunger, an annular cam ring surrounding the distributor member and having inwardly extending cam lobes for imparting inward movement to the plunger as the distributor member rotates so that fuel is expelled from the bore, the fuel being supplied to outlet ports in turn, a cam follower including a roller mounter in a shoe, located between the outer end of the plunger and the cam ring, the cam follower being slidable within a slot formed in the distributor member, the roller being off set from the plunger in the direction of rotation of the distributor member and the surface of the shoe which engages the plunger has a radius with the center of curvature on the axis of the plunger.

2. A pump according to claim 1, in which the slot is of radial form and is of increased width as compared with the shoe the pump including a packing piece interposed between the trailing face of the shoe and the adjacent surface of the slot.

3. A pump according to claim 2, in which the packing piece and the shoe define interengaging elements to ensure the correct disposition of the shoe.

4. A rotary distributor type fuel injection pump for supplying fuel to an internal combustion engine, comprising a plunger slidable within a radial bore formed in a rotary distributor member, means for feeding fuel to the bore to effect outward movement of the plunger, an annular cam ring surrounding the distributor member and having inwardly extending cam lobes for imparting inward movement to the plunger as the distributor member rotates so that the fuel is expelled from the bore, the fuel being supplied to outlet ports in turn, a cam follower including a roller mounter in a shoe, located between the outer end of the plunger and the cam ring, the cam follower being slidable within a slot formed in a part rotatable with the distributor member, the roller being off set from the plunger in the direction of the rotation of the distributor member and the surface of the shoe which engages the plunger has a radius with the center of curvature on the axis of the plunger.

5. A pump according to claim 4, in which the slot is of radial form and is of increased with as compared with the shoe, the pump including a packing piece interposed between the trailing face of the shoe and the adjacent surface of the slot.

* * * * *

UNITED STATES PATENT AND TRADEMARK OFFICE

CERTIFICATE OF CORRECTION

PATENT NO. : 5,178,524

DATED : January 12, 1993

INVENTOR(S) : Stuart W. Nicol

It is certified that error appears in the above-identified patent and that said Letters Patent is hereby corrected as shown below:

Col. 2, line 14, after "respectively" insert a comma --,--; and line 18, after "respectively" delete the comma ",".

Col. 4, line 11, after "shoe" insert a comma --,--; and line 36, delete "with" (first occurrence) and insert therefor --width--.

Signed and Sealed this

Twenty-third Day of November, 1993

*Attest:*

Bruce Lehman

BRUCE LEHMAN

*Attesting Officer*

*Commissioner of Patents and Trademarks*